United States Patent [19]

Neumann

[11] 4,201,938

[45] May 6, 1980

[54] VOLTAGE REGULATOR WHICH ELIMINATES ARCING DURING TAP CHANGES

[75] Inventor: Manfred E. Neumann, New Berlin, Wis.

[73] Assignee: Siemens-Allis, Inc., Atlanta, Ga.

[21] Appl. No.: 947,871

[22] Filed: Oct. 2, 1978

[51] Int. Cl.[2] ..... G05F 1/14

[52] U.S. Cl. ..... 323/43.5 R; 361/13

[58] Field of Search ..... 323/43.5 R; 361/8, 13

[56] References Cited

U.S. PATENT DOCUMENTS

| | | | |
|---|---|---|---|
| 3,252,078 | 5/1966 | Conner | 323/43.5 R |
| 3,330,992 | 7/1967 | Perrins | 361/13 |
| 3,401,303 | 9/1968 | Walker | 361/8 |
| 3,466,530 | 9/1969 | Matzl | 323/43.5 R |
| 3,617,862 | 11/1971 | Stich | 361/13 X |
| 4,061,963 | 12/1977 | Green | 323/43.5 R |

*Primary Examiner*—William M. Shoop
*Attorney, Agent, or Firm*—Frederick W. Powers, II

[57] ABSTRACT

A tap changer voltage regulator permits a tap changer switch selector contact to engage an open circuited new tap without arcing and has a half-tap voltage auxiliary winding which permits halving the voltage being interrupted and doubling the number of steps and also has an auxiliary switch with a first movable contact which initially connects the selector contact on the new tap in series with a circulating current limiting inductor and the load to prevent load circuit interruption and is provided with a second movable contact in series with a pair of normally closed contacts through which flow the load current and the current which circulates while the selector contacts bridge adjacent taps during the tap change. The normally closed contacts are shunted by a pair of inverse parallel thyristors. The auxiliary switch then opens its normally closed contacts to transfer the current to the thyristors and subsequently removes gating current from the thyristors so that load and circulating current are statically interrupted by one of the thyristors at current zero, thereby permitting the second movable contact to arclessly interrupt the circuit to the selector contact on the previous tap to complete the tap change.

8 Claims, 17 Drawing Figures

VOLTAGE REGULATOR WHICH ELIMINATES ARCING DURING TAP CHANGES

BACKGROUND OF THE INVENTION

This invention relates to voltage magnitude control systems of the tap changing type.

A step voltage regulator is an autotransformer provided with load ratio control equipment for regulating the voltage on the feeder or bus to which it is connected. A typical step voltage regulator may have a 100 percent exciting winding in shunt with the line on the source side and normally maintains the voltage on the load side within a desired voltage bandwidth by a 10 percent tapped buck/boost winding in series with the line. The series winding has taps connected to the stationary contacts of a tap changer dial switch having a pair of rotatable selector contacts driven by a reversible motor into sequential engagement with the stationary contacts and usually provides the ability to change the effective turns ratio from input to output plus or minus 10 percent in 32 steps of $\frac{5}{8}$ percent voltage increments. The rotatable contacts of the tap changer switch are usually connected through slip rings to the opposite sides of a bridging centertapped autotransformer reactor, termed a preventive autotransformer, to permit transition from one tap position to another without interrupting the load current. When the selector contacts bridge adjacent stationary contacts, the high reactance of the preventive autotransformer limits circulating current to a safe value and reduces burning and erosion of the tap changer contacts and also provides a voltage midway between the physical taps to thereby provide twice the number of steps. However, such a preventive autotransformer has continuous energy losses in operation and is bulky and expensive to construct, and my copending application Ser. No. 818,987 filed July 25, 1977 discloses a tap changing voltage regulator which eliminates such preventive autotransformer and also prevents arcing at the tap changer selector contacts by providing a half-tap voltage auxiliary winding and an auxiliary switch which permits a selector contact to step arclessly to an open circuited new tap and then connects the selector contact in series with the auxiliary winding and a current-limiting inductor and the load at reduced voltage to effect a tap change without interruption of the load circuit. Although the voltage regulator disclosed in my aforementioned application provides greatly improved results over regulators using preventive autotransformers, it has the disadvantage that arcing occurs at the auxiliary switch contacts during interruption of circulating current.

OBJECT OF THE INVENTION

It is an object of the invention to provide an improved tap changer voltage regulator which eliminates a preventive autotransformer and eliminates arcing at the tap changer switch selector contacts and also arclessly interrupts the current which circulates when the selector contacts are on adjacent taps during a tap change.

DESCRIPTION OF THE DRAWING

The above and other objects and advantages of the invention will be more readily apparent from the following detailed description when considered with the accompanying drawing wherein.

SUMMARY OF THE INVENTION

A tap changer voltage regulator permits a tap changer switch selector contact to engage an open circuited new tap in either direction without arcing and has an auxiliary switch with a first movable contact which couples the selector contact on the new tap through a current limiting inductor to an outgoing load-current-carrying line to prevent load circuit interruption and has a second movable contact in series with a pair of normally closed contacts through which flow the load current and the current which circulates while the selector contacts bridge adjacent taps during the tap change. The normally closed contacts are shunted by a pair of oppositely poled thyristors. The auxiliary switch then opens its normally closed contacts to transfer the current to the thyristors and subsequently removes gating current from the thyristors so that load and circulating currents are statically interrupted at a current zero by the thyristors, thereby permitting the second movable contact to arclessly interrupt the circuit to the selector contact on the previous tap and complete the tap change.

DETAILED DESCRIPTION

Figure 1A:
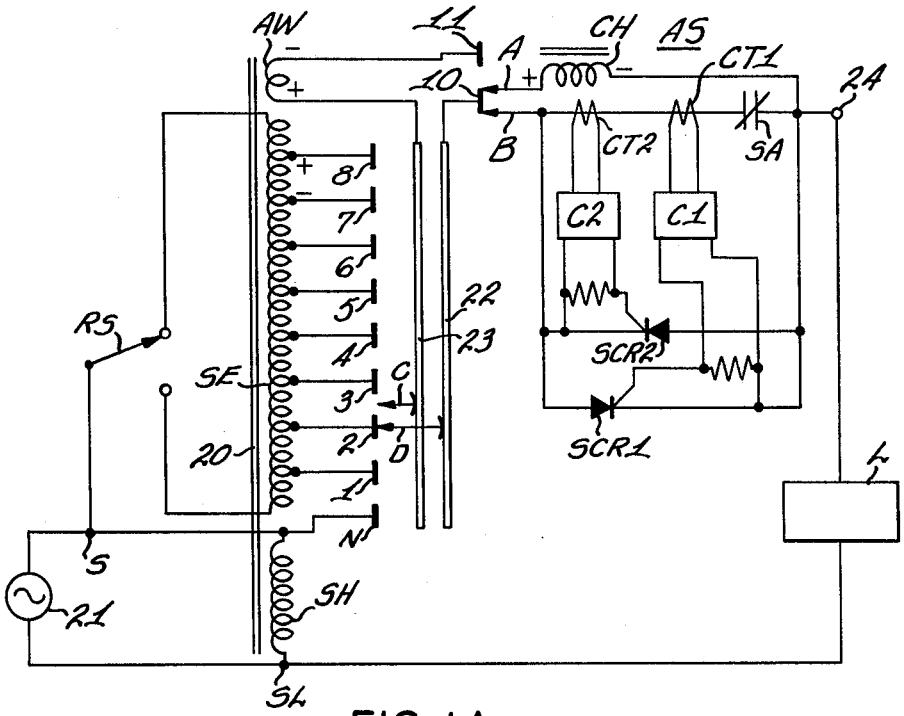
FIG. 1*a* is a schematic circuit diagram of a preferred embodiment of the invention in the quiescent state, the gating circuits for the thyristors being shown in block form, and FIGS. 1*b*–1*h* schematically illustrate successive positions of the elements of the FIG. 1*a* arrangement during a tap change in the voltage raising direction.

A step voltage regulator embodying the invention illustrated in FIG. 1*a* has a 100 percent exciting winding SH which inductively links a magnetic core 20 and is connected across the regulator S and SL bushings which are adapted to be connected to an alternating voltage source 21 such as a power line to be regulated. The regulator also has a 10 percent series winding SE which inductively links magnetic core 20 and is connected in series with the power line and is provided with a plurality of taps connected to the stationary contacts 1–8 of a tap changer dial switch, which contacts are preferably arranged in a circle (not shown). The same reference numerals 1–8 are used to indicate both the stationary contacts and the taps of winding SE to which they are connected. One side of shunt winding SH is connected to a stationary neutral contact N and is also connected to the respective ends of series winding SE by an automatic, mechanically operated reversing switch RS which reverses the polarity of series winding SE so that it may be connected in bucking or boosting relation with shunt winding SH, thereby doubles the range of the tap changer. Two dial switch movable selector contacts C and D are preferably rotatable and sequentially engage the stationary contacts 1–8 and N.

Only one movable selector contact D is in engagement with a stationary contact in the quiescent state of the tap changer switch in the FIG. 1*a* embodiment, and selector contacts C and D are in bridging relation with adjacent stationary contacts or on the same stationary contact only during a tap change. Selector contacts C and D slidably engage conductive collectors 23 and 22 respectively which preferably are slip rings in concentric relation with the circle of stationary contacts 1–8 and N.

Figure 5:
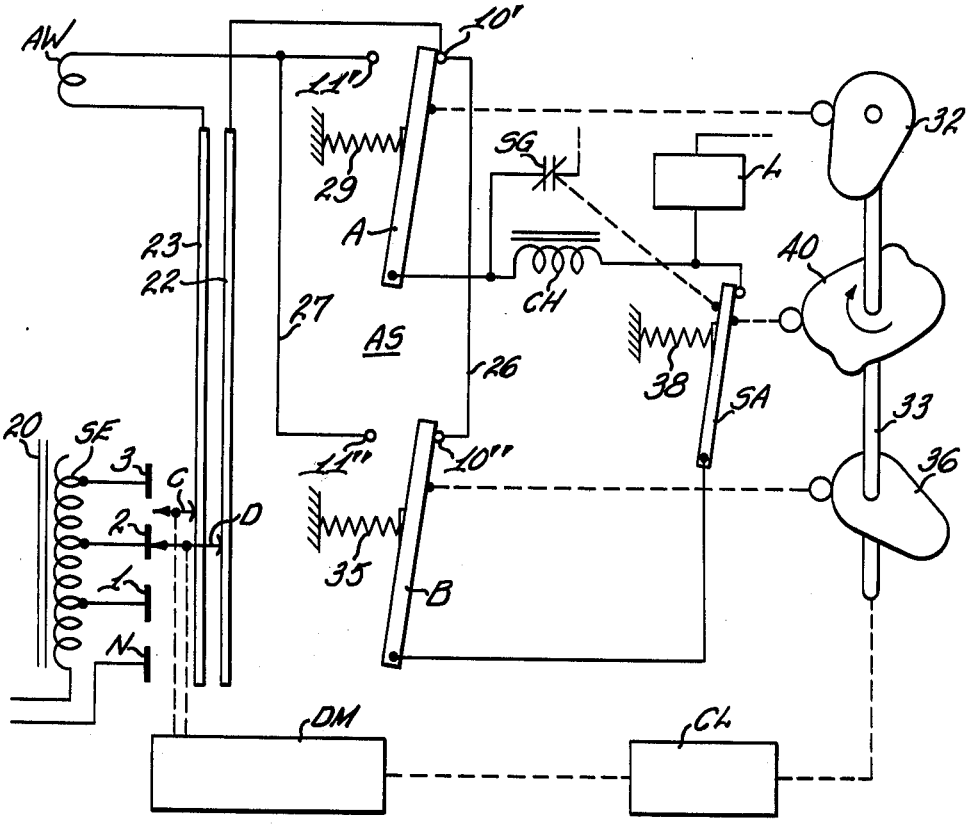
FIG. 5 schematically represents one form of auxiliary switch.

A half-tap voltage auxiliary winding AW inductively linking magnetic core 20 has approximately one half as many turns as the number of turns between adjacent taps of series winding SE so auxiliary winding AW derives a full-step voltage, or half-tap voltage. Preferably auxiliary winding AW is wound to oppose the voltage of series winding SE, but in alternative embodiments (not shown) auxiliary winding AW is in aiding relation to winding SE. One side of auxiliary winding AW may be connected to slip ring 23, and the other side may be connected to the second stationary contact 11 of an auxiliary switch AS whose first stationary contact 10 is connected to slip ring 22. Auxiliary switch AS is preferably operated synchronously with tap changer switch selector contacts C and D by a common drive mechanism DM as schematically illustrated in FIG. 5.

Auxiliary switch AS has a first movable contact A and a second movable contact B, both of which normally engage the same stationary contact 10 or 11 and are adapted to step between stationary contacts 10 and 11 so that the first movable contact A always disengages the one stationary contact and engages the other stationary contact before the second movable contact B leaves the one stationary contact. The first movable contact A is connected through an inductive choke CH to an output lead, or terminal 24 which is connected to load L, and the second movable contact B is connected to output lead 24 through a pair of normally closed contacts SA of the auxiliary switch. A pair of oppositely poled, or inversely parallel SCR's, or thyristors SCR 1 and SCR 2 are connected between second movable contact B and lead 24 in shunt to contacts SA so that load current flowing through selector contact D engaging tap 2 also flows through movable contact B and contacts SA. The thyristor control circuits C1 and C2 shown in block form in FIG. 1 and in detail in FIG. 2 respectively regulate gating of SCR 1 and SCR 2 and receive inputs from current transformers CT1 and CT2 whose primary windings are energized in proportion to the load current flowing through contacts SA. The disclosed arrangement is adapted to regulate voltage supplied to load L connected between the output lead 24 and the SL bushing.

FIGS. 1*b* through 1*h* illustrate successive conditions of the elements during a tap change in the voltage raising direction. FIG. 1*a* shows the state of the elements before and after a tap change. Selector contact D is on tap changer switch stationary contact 2, selector contact C is between stationary contacts, or taps 2 and 3, and auxiliary switch movable contacts A and B engage auxiliary switch stationary contact 10. The electrical circuit to the load L may be traced from bushing S, reversing switch RS, one end of winding SE, stationary contact 2, selector contact D, slip ring 22, auxiliary switch stationary contact 10, movable contact B, auxiliary switch contacts SA, output lead 24, and load L to bushing SL.

Figure 1B:
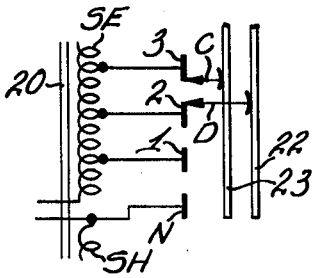
Figure 1C:
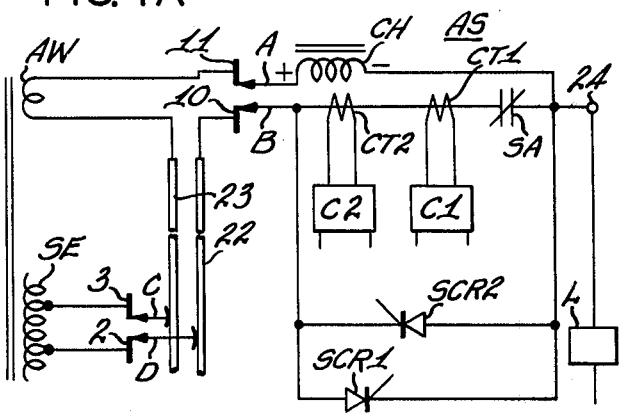

Selector contact C is free to move to a new tap in the raise direction without arcing since it is open circuited at auxiliary switch stationary contact 11 and thus is not carrying current. In FIG. 1*b* selector contact C has been moved arclessly into engagement with stationary contact 3 while selector contact D remains on stationary contact 2. Operation of auxiliary switch AS to effect a tap change is initiated by movable contact A leaving stationary contact 10 and engaging stationary contact 11 while movable contact B remains in engagement with stationary contact 10, as shown in FIG. 1*c*, thereby completing a circuit to the load L which may be traced from tap changer switch stationary contact 3, selector contact C, slip ring 23, auxiliary winding AW, auxiliary switch stationary contact 11, first movable contact A, and choke CH to output lead 24 and the load L. At this instant the current to the load is still being maintained through selector contact D, slip ring 22, movable contact B, and contacts SA. Thyristors SCR 1 and SCR 2 are shorted by contacts SA. The current through inductive choke CH, which is now in series with the load, cannot change instantaneously when movable contact A engages stationary contact 11 but must build up from zero through choke CH, so no current is flowing through movable contact A when it engages stationary contact 11, and contact A thus closes without arcing. However, circulating current now starts to flow in a circuit which may be traced from the portion of winding SE between taps 2 and 3, tap 3, selector contact C, collector 23, auxiliary winding AW, stationary contact 11, movable contact A, choke CH, contacts SA, movable contact B, stationary contact 10, collector 22, selector contact D and tap 2, but such circulating current must build up gradually through choke CH.

Current transformers CT1 and CT2 monitor the current flowing through contacts SA and provide inputs to control circuits C1 and C2 so that gating current is continuously supplied to SCR 1 and SCR 2.

Figure 1D:
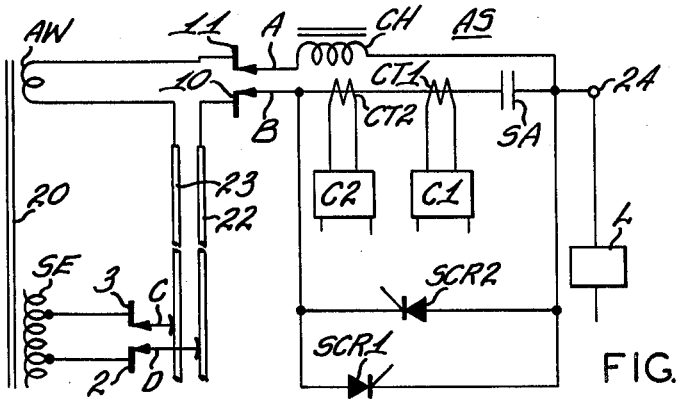
Figure 1E:
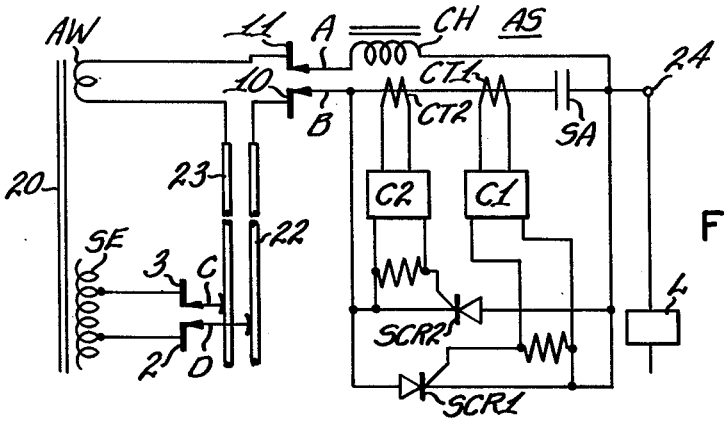

Auxiliary switch AS now opens its contacts SA, as illustrated in FIG. 1*d*, to transfer load and circulating current from contacts SA to thyristors SCR 1 and SCR 2 which were receiving gating current and begin to conduct (as illustrated by the black arrowheads for the SCR symbol). The opening of contacts SA is essentially arcless because they are shunted by thyristors SCR 1 and SCR 2. After contacts SA open, current no longer flows through current transformers CT1 and CT2, and after a predetermined time delay control circuits C1 and C2 remove gating current from SCR 1 and SCR 2 as described hereinafter. Since gating current is no longer being applied to SCR 1 and SCR 2, they turn off at load current zero, as illustrated by the white arrowheads of the SCR symbols in FIG. 1*e*, and thus statically interrupt the load and circulating current flowing through selector contact D. Load current now flows through selector contact C, collector 23, auxiliary winding AW, auxiliary switch stationary contact 11, movable contact A and choke CH to terminal 24 and load L.

Figure 1F:
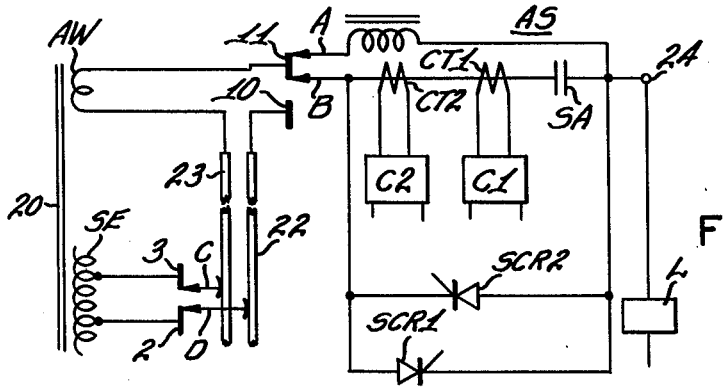

Auxiliary switch contact B is now free to move arclessly from stationary contact 10 and into engagement with stationary contact 11 to interrupt the circuit through selector contact D since the circuit thereto is open at both contacts SA and at the thyristors SCR 1 and SCR 2, as illustrated in FIG. 1*f*. Load current is flowing briefly through inductor CH which serves to limit the circulating current that flows while selector contacts C and D bridge adjacent tap changer switch stationary contacts 2 and 3.

Figure 1G:
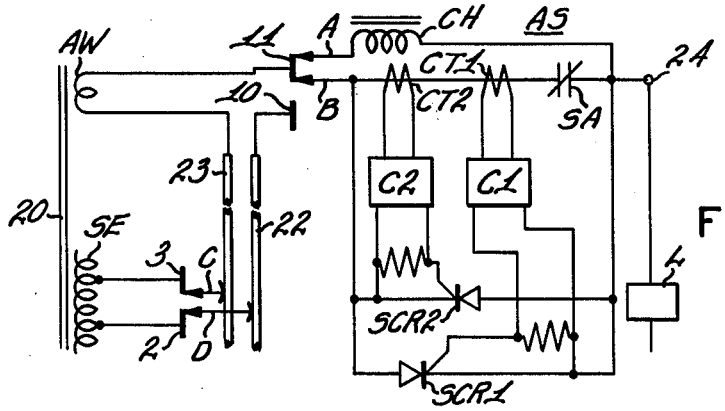
Figure 1H:
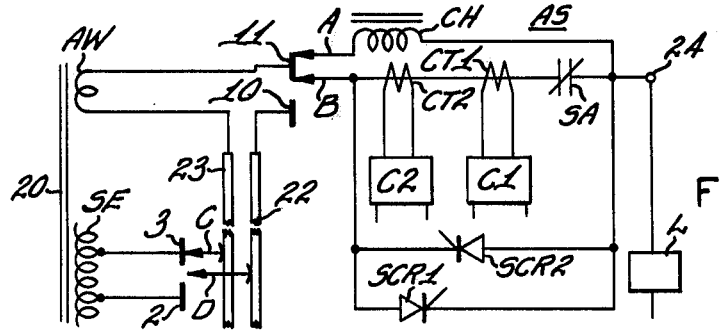

Auxiliary switch AS now closes its SA contacts, as illustrated in FIG. 1*g*, to shunt the load current from inductor CH. The primary windings of current transformers CT1 and CT2 are now energized in proportion to the load current flowing through contacts SA and provide inputs to controls C1 and C2 which respectively provide gating current to SCR 1 and SCR 2. If bounce of the SA contacts should occur, SCR 1 or SCR 2 would conduct the load current while the SA contacts were temporarily open, thereby preventing erosion and burning of the SA contacts. Selector contact C is now carrying load current, and selector contact D is disengaged from tap changer switch stationary contact 3 under zero current condition and is actuated to a position between tap changer switch stationary contacts 2 and 3 as illustrated in FIG. 1*h* to complete the tap change.

Figure 2:
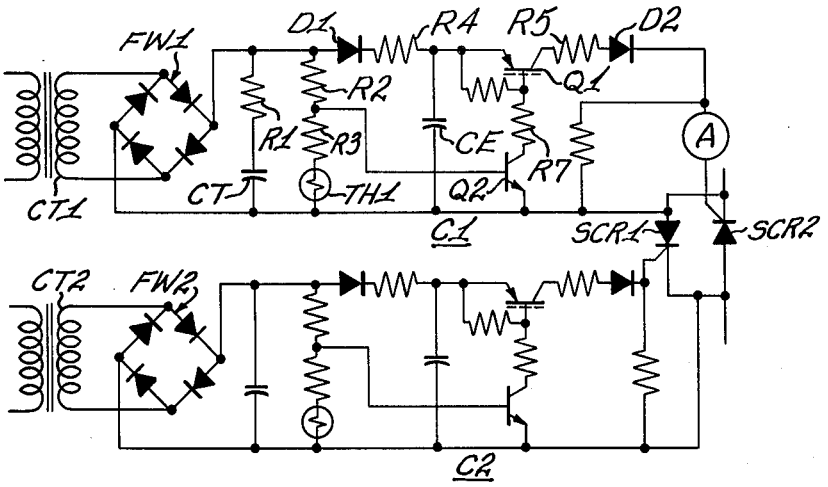
FIG. 2 shows the schematic circuit diagrams of the thyristor gating circuits represented in block form in FIG. 1.

Load current flowing through the SA contacts induces current in secondary windings of current transformers CT1 and CT2 which are rectified in full-wave rectifiers FW1 and FW2 of control circuits C1 and C2 shown in FIG. 2. Only circuit C1 will be described. The output from FW1 charges a timing capacitor CT through a timing resistance R1 and also charges an energy storage capacitor CE through a diode D1 and a resistance R4. Capacitor CE supplies gating current to the gate-cathode junction of SCR 2 over conductors designated + and − through the emitter-collector path of a transistor switch Q1, a resistance R5 and a diode D2.

The base of Q1 is connected to the − conductor through a resistance R7 in series with collector-emitter path of a transistor Q2, and switch Q1 remains conducting as long as Q2 is turned on. The base of Q2 is connected to a point on a voltage divider comprising the series arrangement of two resistances R2 and R3 and a thermistor TH1 connected between the + and − conductors. After auxiliary switch AS opens its SA contacts, the output of FW1 becomes zero and timing capacitor CT discharges through R2, R3 and TH1, thereby providing a voltage to maintain Q2 on for a predetermined time delay interval after the SA contacts open. During such predetermined time delay capacitor CE supplies gating current through switch Q1 to maintain SCR 2 conducting, thereby assuring that thyristor SCR 2 conducts load current until the SA contacts have opened sufficiently to assume the system voltage. Circuit C2 operates in a similar manner for SCR 1.

Figure 3:
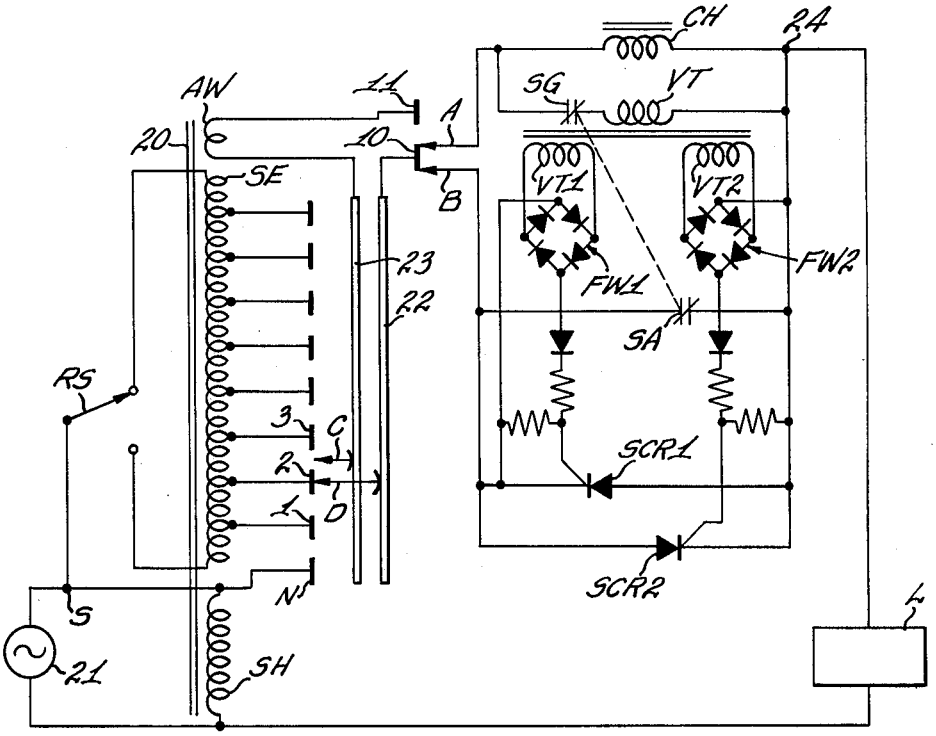
FIG. 3 is a schematic circuit diagram of an embodiment having an alternative arrangement for controlling the gating of the thyristors.

The FIG. 2 embodiment utilizes a separate control circuit for each thyristor that has a relatively large number of components and requires an expensive current transformer for monitoring the current through the SA contacts. An alternative gating circuit for SCR 1 and SCR 2 is shown in FIG. 3 which: (1) eliminates a substantial number of components and a significant proportion of the cost of the FIG. 2 circuit; (2) energizes the gates of SCR 1 and SCR 2 only during a tap change to thereby substantially increase their life; and (3) provides protection against surge voltages. The FIG. 3 circuit replaces the two current transformers of the FIG. 1*a* embodiment with a single voltage transformer VT having its primary winding in series with a normally closed gate-current-removing switch SG across inductor CH. Switch SG may be a microswitch and preferably is mechanically operated by contacts SA after they have opened sufficiently to withstand the system voltage. The primary of transformer VT only sees a voltage across choke CH after auxiliary switch movable contact A has been actuated into engagement with stationary contact 11. The resulting voltage induced in the secondary windings VT2 and VT3 of voltage transformer VT are rectified in full wave rectifiers FW1 and FW2 and derive gating currents for SCR 1 and SCR 2. Switch SG is opened subsequent to opening of the SA contacts during a tap change to immediately remove SCR gating current so that the circulating and load current flowing through movable contact B is interrupted by SCR 1 or SCR 2 at the next current zero. Movable contact B is then open circuited and is free to move into engagement with stationary contact 11 without arcing.

FIGS. 4*a*–4*f* illustrate successive positions of the components of still another embodiment which eliminates the voltage transformer and numerous components of the FIG. 3 circuit and requires only a single gate current supply that includes the series arrangement of a diode D10 and a capacitor C10 connected between auxiliary switch movable contacts A and B. A resistor R10 is in shunt to capacitor C10. The junction of diode D10 and capacitor C10 is connected through normally closed auxiliary switch SG to one side of diodes D20 and D30 which are respectively connected through resistances R20 and R30 to the gates of SCR 1 and SCR 2.

Figure 4A:
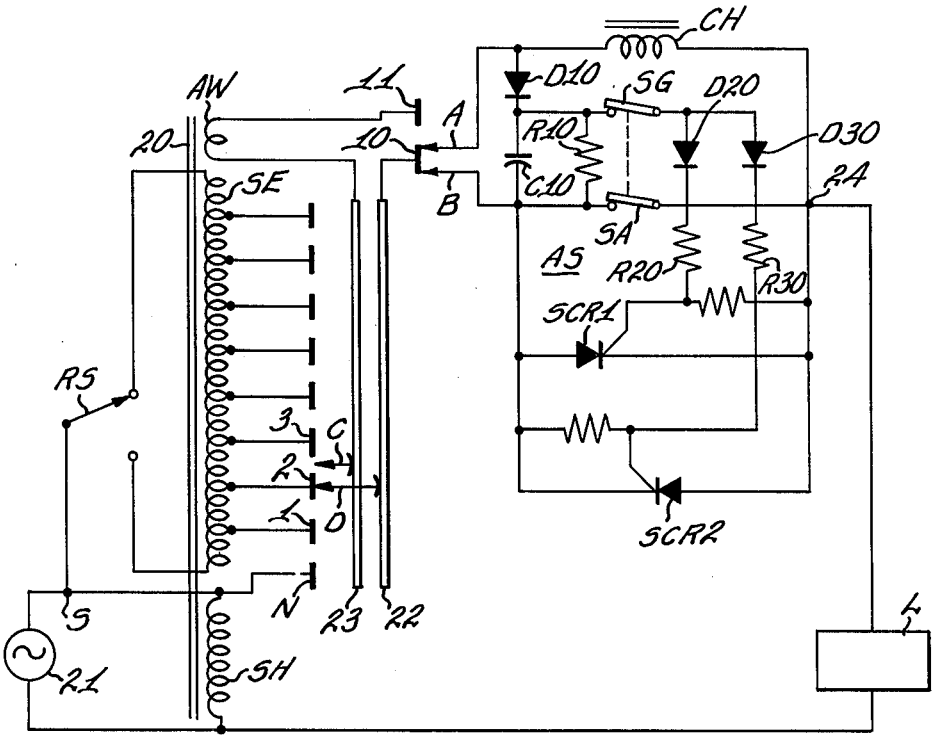
FIGS. 4*a*–4*f* illustrate successive positions of the components during a tap change in an alternative embodiment having still another arrangement for gating the thyristors.
Figure 4B:
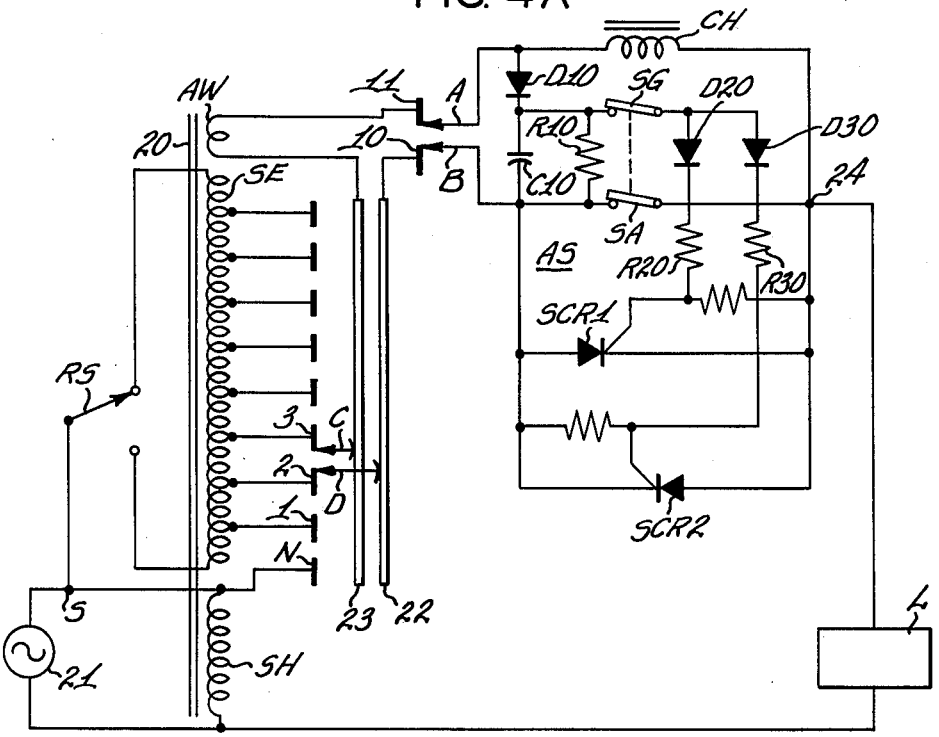
Figure 4C:
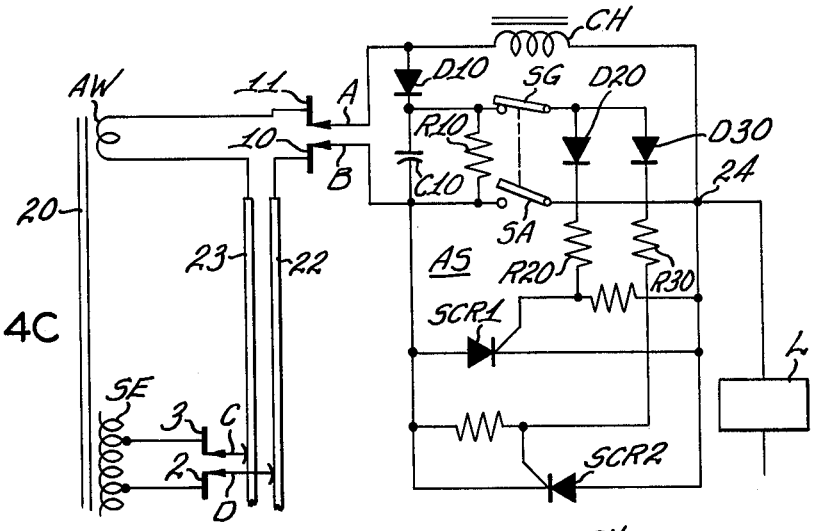

FIG. 4*a* shows the quiescent state before and after a tap change wherein contacts A, B and SA are all coupled to load terminal 24. The inductor current, the capacitor voltage and the thyristor voltages are zero. Selector contact D engages tap 2 and selector contact C is between taps 2 and 3. When a tap change in the raise direction is initiated, open circuited selector contact C is moved into engagement with tap 3 and movable contact A is subsequently disengaged from stationary contact 10 and engaged with stationary contact 11, as shown in FIG. 4*b*, to complete a circuit through inductor CH to load terminal 24. Since selector contacts C and D are on adjacent taps 2 and 3, the voltage induced in the portion of winding SE between taps 2 and 3, minus the opposing voltage of auxiliary winding AW, causes circulating current to flow in a path through selector contact C, movable contact A, choke CH, contacts SA, movable contact B and selector contact D. This circulating current adds vectorially to the load current flowing through the SA contacts. A voltage now appears across capacitor C10, and gate current flows through gate-current-removing switch SG, diodes D20 and D30 and resistances R20 and R30 to the gates of SCR 1 and SCR 2. The SA contacts are then opened, as shown in FIG. 4*c*, while the gate-current-removing switch SG remains closed so gate current is flowing through diodes D10, D20 and D30 (as indicated by the black arrowheads), thereby transferring load current to SCR 1 and SCR 2. Dependent upon the polarity of the voltage half cycle at which the SA contacts open, the SCR 1 cathode return path to the common of the DC gate current source may be either through SCR 2 or through inductor CH in series with auxiliary winding AW.

Figure 4D:
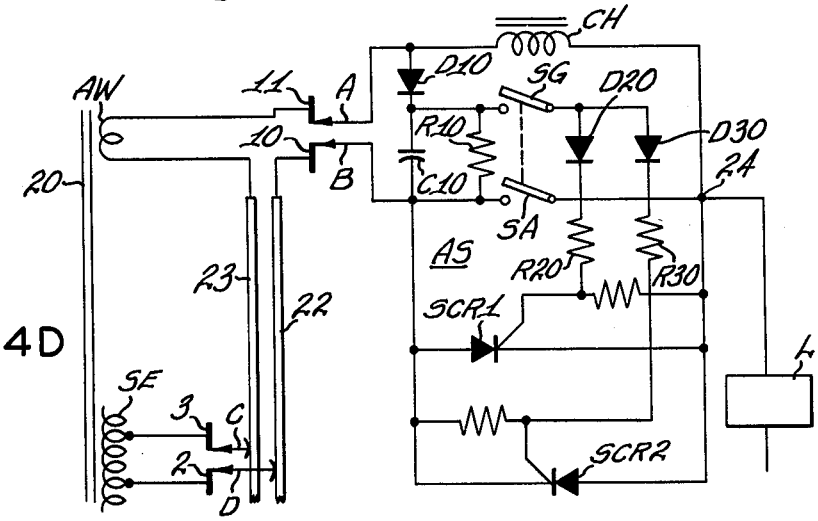
Figure 4E:
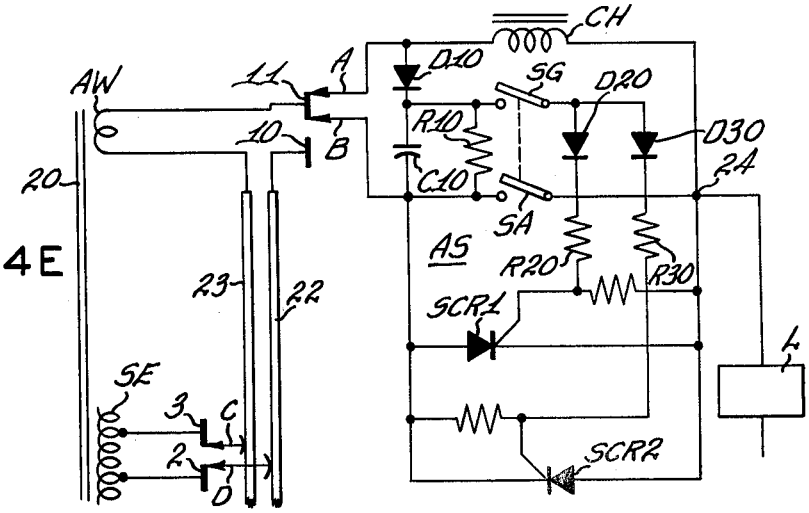
Figure 4F:
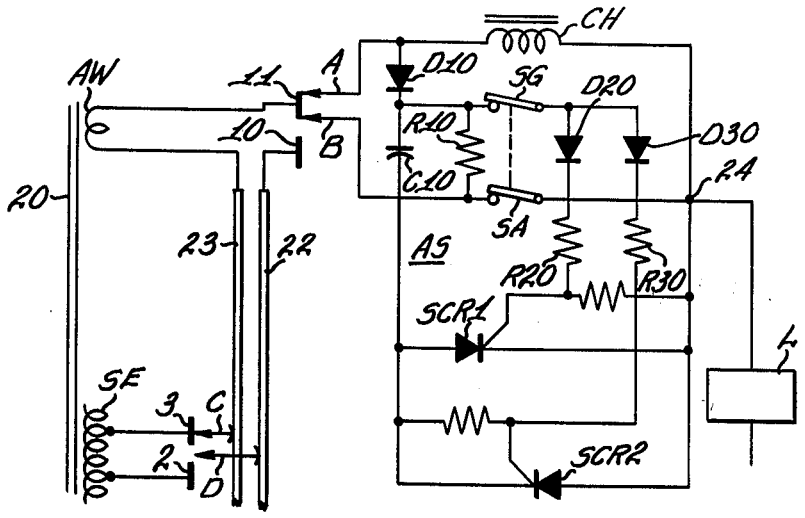

After the SA contacts have separated sufficiently far to assume the system voltage, the gate-current-removing switch contacts SG are opened, as shown in FIG. 4*d*, to interrupt gate current to both SCR's, and static interruption of load and circulating current occurs at the next current zero of either SCR 1 or SCR 2. Load current now flows temporarily through inductor CH. FIG. 4*e* shows that movable contact B is now actuated arclessly from stationary contact 10 to stationary contact 11. The SA contacts are subsequently closed, as shown in FIG. *4f*, to short SCR 1 and SCR 2 and to also short circuit inductor CH, and load current flows through the SA contacts to the load terminal 24. Switch SG now closes as also shown in FIG. *4f*. Switch SG can close before or after the SA contacts, and SCR 1 or SCR 2 might turn on briefly if SG closes before the SA contacts. Selector contact D is now open circuited at stationary contact 10 and is actuated to a position between taps 2 and 3 as shown in FIG. *4f* to complete the tap change.

FIG. 5 schematically illustrates a preferred form of auxiliary switch AS in which stationary contact 10 comprises two stationary conductive portions 10' and 10'' connected together by a lead 26 and also connected to slip ring 22 and stationary contact 11 comprises two stationary conductive portions 11' and 11'' connected together by a lead 27 and also connected to one side of auxiliary winding AW. Movable contact A is of the pivoted knife blade type and is resiliently urged by a compression spring 29 into engagement with stationary contact portion 10' and is operatively associated with a cam 32 mounted on a camshaft 33 and adapted to be operated by cam 32 into engagement with stationary contact portion 11' against the force of spring 29 and also to be returned by spring 29 under the control of cam 32 into engagement with stationary contact portion 10'. Similarly auxiliary switch movable contact B is of the pivoted knife blade type resiliently urged by a compression spring 35 into engagement with stationary contact portion 10'' and is operatively associated with a cam 36 mounted on camshaft 33 and adapted to be operated by cam 36 into engagement with stationary contact portion 11'' against the force of spring 35 and also to be returned by spring 35 under the control of cam 36 into engagement with stationary contact portion 10''. Normally closed contacts SA include a pivoted knife type movable blade resiliently urged by a compression spring 38 into engagement with a stationary contact and operatively associated with a double lobe cam 40 mounted on camshaft 33 and adapted to be disengaged from the stationary contact by each lobe against the force of spring 38 and to be returned by spring 38 under the control of cam 40 into engagement with the stationary contact. Microswitch SG is shown as being controlled by movable knife blade SA.

Tap changer selector contacts C and D are operated by a suitable drive mechanism DM which also synchronously drives camshaft 33 through a suitable one-way clutch CL so that camshaft 33 has unidirectional rotation. It will be appreciated that cams 32, 36 and 40 are mounted on camshaft 33 so that as it rotates 180° during the tap change illustrated in FIGS. *4a–4f* in sequence: (a) cam 32 disengages blade A from 10' and engages it with 11'; (b) a lobe or cam 40 opens contacts SA; (c) blade SA opens the contacts of microswitch SG and then (d) cam 36 disengages blade B from 10'' and engages it with 11''. During the succeeding tap change in the same direction in sequence: (1) cam 32 permits blade A to be returned by spring 29 into engagement with 10'; (2) the other lobe on cam 40 disengages blade SA from the stationary contact; (3) blade SA opens the contacts of microswitch SG and then (4) cam 36 permits blade B to move under the force of spring 35 into engagement with 10''.

While only a few embodiments of my invention have been illustrated and described, many modifications and variations thereof will be readily apparent to those skilled in the art, and consequently I do not intend to be limited to the particular embodiments shown and described.

The embodiments of the invention in which an exclusive property or privilege is claimed are defined as follows:

1. In a tap changing voltage regulator having an exciting winding, a tapped electrical winding inductively linked to said exciting winding and having a plurality of taps, a pair of tap changer switch selector contacts adapted to sequentially engage said taps, an auxiliary winding inductively linked to said exciting winding and being coupled at one end to one of said selector contacts, an auxiliary switch having first and second stationary contacts connected respectively to the other end of said auxiliary winding and to the other selector contact and also having first and second movable contacts normally engaging the same stationary contact and a pair of normally closed contacts, said first movable contact being connected through an inductor to an outgoing load-current-carrying line and said second movable contact being connected through said normally closed contacts to said outgoing line, a pair of inversely parallel thyristors connected in shunt to said normally closed contacts, said auxiliary switch being adapted to step said first and second movable contacts between said stationary contacts and to disengage said first movable contact from one stationary contact and to engage it with the other before said second movable contact disengages said one stationary contact and to then open said normally closed contacts and to subsequently disengage said second movable contact from said one stationary contact and engage it with the other, whereby circulating current may flow through said movable contacts, said inductor and said normally closed contacts when said selector contacts bridge adjacent taps during a tap change, means for supplying gating current to said thyristors during a tap change and for removing said gating current subsequent to the opening of said normally closed contacts but prior to the disengagement of said second movable contact from said one stationary contact, whereby circulating and load current are statically interrupted by said thyristors at a current zero and said second movable contact is then free to move arclessly into engagement with said other stationary contact.

2. A tap changer voltage regulating arrangement including a tapped electrical winding having a plurality of taps, a half-tap voltage auxiliary winding inductively linked to said tapped winding, a pair of selector contacts adapted to sequentially engage said taps, one of said selector contacts being coupled to one side of said auxiliary winding, an auxiliary switch having first and second stationary contacts coupled respectively to the other side of said auxiliary winding and to the other selector contact and also having first and second movable contacts normally engaging the same stationary contact, an inductor connected between said first movable contact and an outgoing load-current-carrying line, a pair of normally closed contacts connected between said second movable contact and said line, a pair of inversely parallel thyristors connected in shunt to said normally closed contacts, said auxiliary switch first and second movable contacts adapted to be stepped alternatively between said first and second stationary contacts so that said first movable contact always leaves one stationary contact and engages the other to complete a circuit through said inductor to said outgoing line before said second movable contact disengages said one stationary contact, whereby circulating current may flow in a path through said selector contacts and said inductor and said normally closed contacts during a tap change, and means for supplying gating current to said thyristors during a tap change and for removing said gating current subsequent to opening of said normally closed contacts, whereby said circulating current is interrupted by said thyristors at current zero and said second movable contact is then free to move without arcing into engagement with said other stationary contact to complete the tap change.

3. In combination with a tap changer voltage regulator having a pair of selector contacts movable sequentially between a plurality of fixed tap contacts connected to the tappings of the regulator winding, an auxiliary winding inductively linked to said tapped winding and having one end coupled to one of said selector contacts, an auxiliary switch having a first stationary contact coupled to the other end of said auxiliary winding and a second stationary contact coupled to the other selector contact and also having first and second movable contacts normally engaging the same stationary contact and adapted to be stepped between said stationary contacts so that said first movable contact always disengages one stationary contact and engages the other before said second movable contact disengages said one stationary contact, an inductor connected between said first movable contact and an outgoing load-current-carrying line so that a selector contact on a new tap is connected to said outgoing line without circuit interruption, a pair of normally closed contacts connected between said second movable contact and said outgoing line, a pair of inversely parallel thyristors in shunt to said normally closed contacts, and wherein engagement of said first movable contact with said other stationary contact during a tap change results in circulating current through said selector contacts, said inductor, said auxiliary switch contacts and said normally closed contacts, means for supplying gating current to said thyristors during a tap change, means for opening said normally closed contacts after said first movable contact has engaged said other stationary contact but before said second movable contact has disengaged said one stationary contact, and means for removing said gating current from said thyristors subsequent to opening of said normally closed contacts during a tap change, whereby said circulating current is statically interrupted by said thyristors at a current zero and said second movable contact is then free to move without arising arcing into engagement with said other stationary contact.

4. In the combination of claim 1, 2 or 3 wherein the voltage induced in said auxiliary winding is opposed and equal to approximately one half of the voltage induced in the portion of said tapped winding between adjacent taps.

5. In the combination of claim 1, 2 or 3 wherein said means for supplying gating current includes the series arrangement of a capacitor with a diode connected between said first and second movable contacts, circuit means for connecting the voltage developed across said capacitor to the cathode-gate junctions of said thyristors through a normally closed electrical switch, and wherein said electrical switch is opened in response to the opening of said normally closed contacts to thereby remove gating current from said thyristors.

6. In the combination of claim 1, 2 or 3 wherein said means for supplying gating current to said thyristors includes current transformer means for detecting current flow through said normally closed contacts, means responsive to a predetermined output from said current transformer means for applying gating current to the cathode-gate junctions of said thyristors and being adapted to maintain said gating current thereto for a predetermined time interval after the output from said current transformer means has dropped below said predetermined output.

7. In the combination of claims 1, 2 or 3 wherein said means for supplying gating current includes a voltage transformer shunted across said inductor.

8. In the combination of claims 1, 2 or 3 wherein the voltage of said auxiliary winding is opposed to that of said tapped winding.

* * * * *